US005463792A

United States Patent [19]

Hogan et al.

[11] Patent Number: 5,463,792

[45] Date of Patent: Nov. 7, 1995

[54] ASPIRATING TOOTH BRUSH

[76] Inventors: James E. Hogan, P.O. Box 101, Atlanta, Tex. 75551; Mary A. Brown, 2505 Shadow La., McKinney, Tex. 75070

[21] Appl. No.: 173,121

[22] Filed: Dec. 27, 1993

[51] Int. Cl.[6] ..... A45D 44/18

[52] U.S. Cl. ..... 15/322; 15/105; 15/398; 132/308; 433/91

[58] Field of Search ..... 15/398, 321, 322, 15/302, 105; 132/308; 433/91

[56] References Cited

U.S. PATENT DOCUMENTS

| | | | |
|---|---|---|---|
| D. 274,575 | 7/1984 | Kronner | D4/15 |
| 2,150,842 | 3/1939 | Oliver | 15/321 X |
| 2,154,209 | 4/1939 | Kohn | 15/105 X |
| 3,361,355 | 1/1968 | Reneé | 15/105 X |
| 3,645,288 | 2/1972 | Dawkins | 137/255 |
| 4,429,434 | 2/1984 | Sung-shan | 15/341 |
| 4,538,631 | 9/1985 | Prince | 15/167.1 X |

*Primary Examiner*—Chris K. Moore
*Attorney, Agent, or Firm*—John E. Vandigriff

[57] ABSTRACT

The invention is to an aspirating tooth brush which has a vacuum drawn through the tooth brush handle and openings in the side of the tooth brush handle opposite the bristles, and an inlet in the end of the brush body to which the vacuum line is attached. The handle may also have a second channel in the handle for dispensing water into the mouth during brushing and aspirating.

13 Claims, 5 Drawing Sheets

ASPIRATING TOOTH BRUSH

FIELD OF THE INVENTION

This invention relates to toothbrushes, and more particular to a vacuum tooth brush for removing fluids from the mouth during and after brushing the teeth, particularly for the disable and infirmed.

BACKGROUND OF THE INVENTION

Various tooth brush designs include a tooth brush in connection with a vacuum or suction device to remove plaque and other debris from the mouth during brushing of the teeth. These tooth brush instruments are useful for persons confined to bed in nursing homes and hospitals, and for brushing the teeth of handicapped and infirmed persons.

The present aspirator tooth brushes draw a vacuum through and around the tooth brush bristles. This pulls food particles and other debris into the tooth brush bristles.

Examples of aspirating tooth brushes that draw the mouth debris through and around the bristles are shown in U.S. Pat. Nos. 4,538,631, and 4,903,688. Most of these prior art devices require a vacuum source and disposal apparatus. These apparatus are not portable, and have to be used at a location at which the apparatus is installed.

SUMMARY OF THE INVENTION

The invention is to an aspirating tooth brush which has a vacuum drawn through the tooth brush handle and openings in the side of the tooth brush opposite the bristles, and an opening in the end of the brush body. Evacuation of the saliva and food debris is through the back of the brush handle and is not drawn through the brush bristles. The brush is easier to clean and simpler to construct. It helps keep the mouth debris out of the bristles which can cause bacterial growth. The brush can be connected to a portable vacuum system, providing a portable aspirating tooth brush.

The brush can also be connected to a water faucet to create a vacuum, and can be used any where there is a water faucet. The brush can also be connected to any saliva ejector system such as those used in dental offices. A saliva ejector is easy to install where there is a water and drainage facility.

In a second embodiment, the tooth brush is connected to a valve that can, in a first position, supply water to the mouth for brushing the teeth and providing a rinse water. When the valve is in a second position, a vacuum is created, removing fluids and debris from the mouth.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
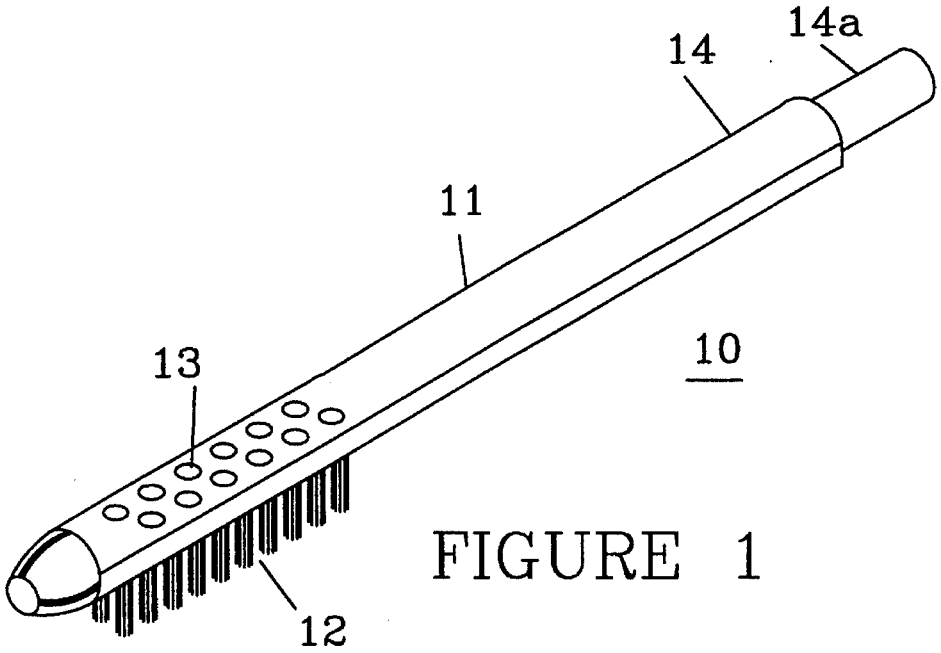
FIG. 1 shows a tooth brush of the present invention.

The invention is to a tooth brush 10 as illustrated in FIG. 1 that has hollow handle/body 11 having bristles 12 on one side and a plurality of openings 13 on the side of the handle 11 opposite the side holding the bristles. End 14 has a reduced portion on which a tube may be attached. Openings 13 are connected through the hollow body 11 to outlet end 14.

Figure 2:
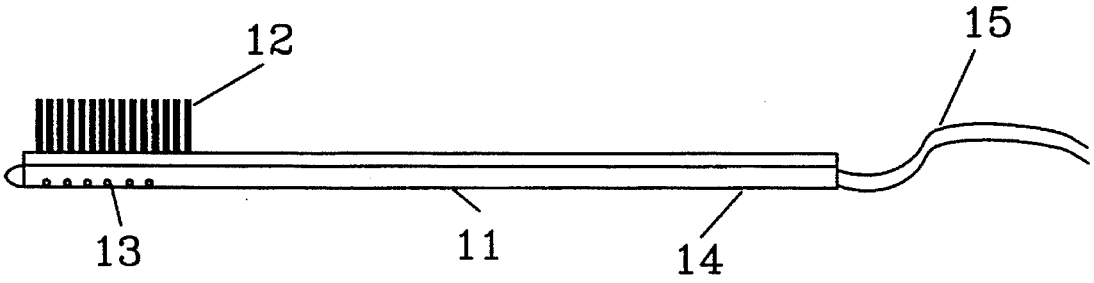
FIG. 2 is a side view of the toothbrush of FIG. 1.

FIG. 2 is a side view of tooth brush 10 of FIG. 1. Holes 13 are clearly shown to be on the side of hollow handle 11 opposite from bristles 12. A flexible tube 15 is connected to an outlet opening in the end of handle 11, opposite the end of the holes 13 and bristles 12.

Figure 3:
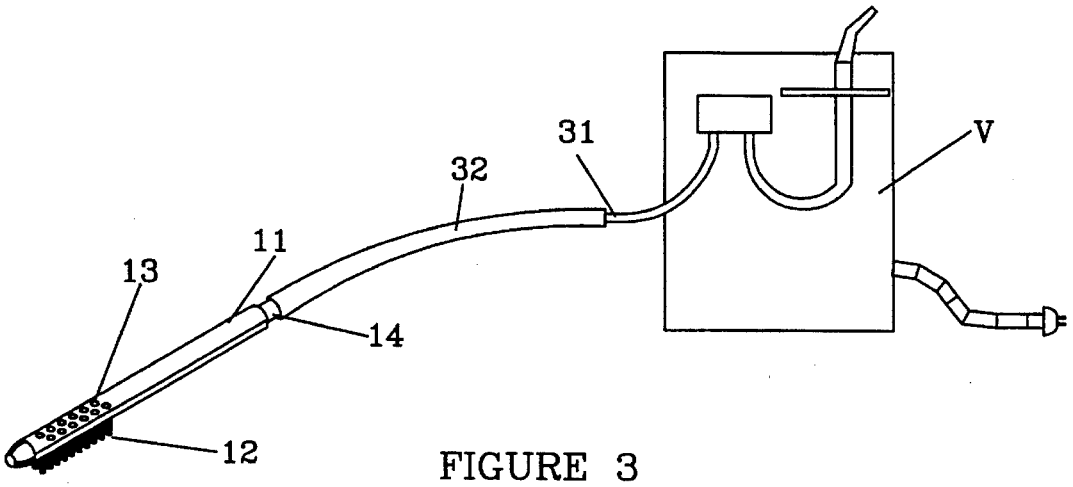
FIG. 3 shows the tooth brush of FIG. 1 connected to a portable electric vacuum system.

FIG. 3 illustrates tooth brush 10 connected to a portable electric vacuum system V. Brush 10, connected to a portable vacuum system V via outlet end 14 and tubes 32 and 31 is advantageously used by a nurse or attendant for cleaning the teeth and mouth of person who are reclining on a bed. The person does not have to spit to clear their mouth of saliva, or other debris, and are less likely to choke. The combination of brush 10 and vacuum system V provides a way to clean the teeth and mouth of any person who is unable to do their own oral hygiene.

Figure 4:
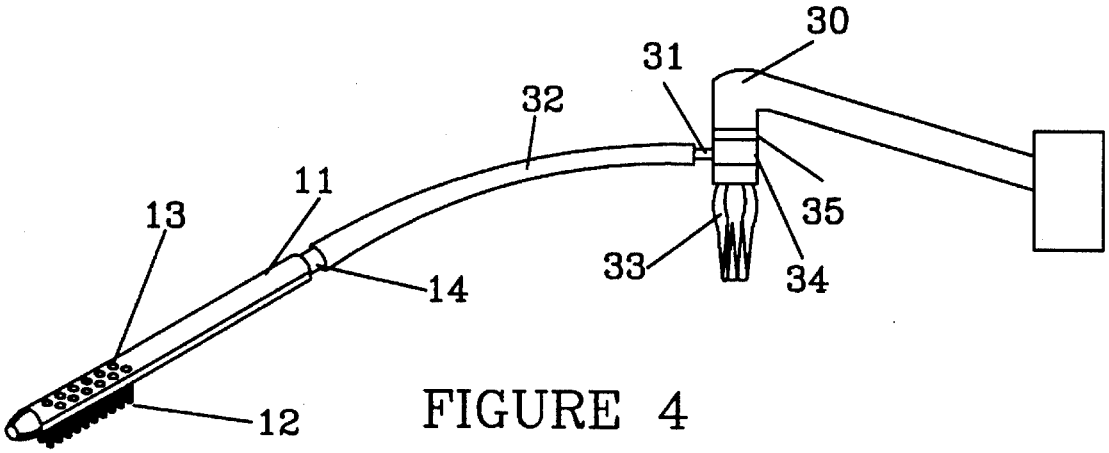
FIG. 4 shows the toothbrush of the present invention in combination with a water source to produce a vacuum.

FIG. 4 illustrates utilization of tooth brush 10 with a water facet 30 and an attachment 34 which is attached to the dispensing end 35 of water facet 30. Attachment 34 has a nipple 31 to which is attached flexible tube 32. Also attached to flexible tube 32 is tooth brush 10 attached at outlet end 14. Tooth brush 10 is attached to the faucet, and the water is turned on. The flow of water produces a vacuum through openings 13. As brush 10 is moved around, the vacuum draws tooth paste and saliva out of the mouth through outlet end 14 and tube 32 while the teeth are being brushed.

It should be noted that since the holes 13, through which the vacuum is drawn, are on the opposite side of the handle from bristles 12, so that bristles 12 do not impede the withdrawing of debris from the mouth. This gives a suction brush connected to any water faucet.

Figure 5:
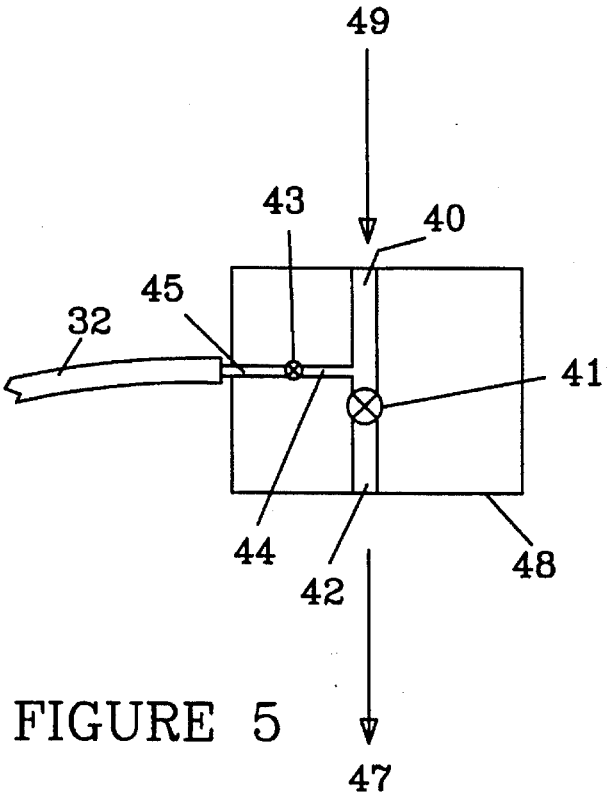
FIG. 5 illustrates an example of valve use with a water source.

FIG. 5 illustrates a valve assembly 34 attachment that can be used with the tooth brush 10 to provide both a vacuum and source of water to rinse the mouth.

The attachment of FIG. 5 utilizes a source of water under pressure which is directed through inlet 40, flows through valve 41, and out outlet 42. This flow of water creates a vacuum in line 45, tube 32 and through the openings 13 in brush 10.

Valve assembly 34 and tooth brush 10 work together as follows. A source of water under pressure is directed though inlet 40, flows through valve 41 and out outlet 42. The flow of water in inlet 40 through valve 41 and outlet 42 will created a vacuum through line 45, tube 32 and through openings 13 in tooth brush 10. When rinse water is required, valve 41 is at least partially closed allowing water to flow through valve 43 to tooth brush 10, and out holes 13. Valve 43 is used to regulate the amount of water that is permitted to flow into the tooth brush. When the rinse water and other debris is to be removed from the mouth, valve 41 is opened to create the vacuum through openings 13 in tooth brush 10, drawing rinse water and other fluids and debris out of the mouth.

Figure 6:
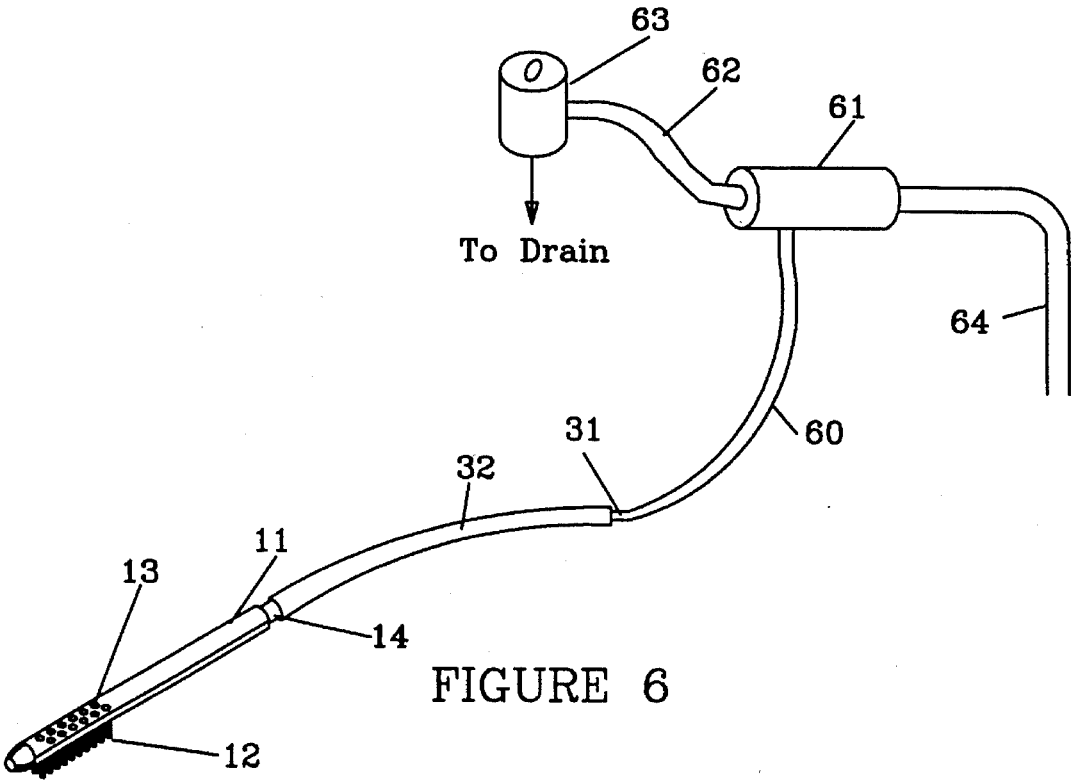
FIG. 6 shows the tooth brush of the present invention connected to a saliva ejector such as those used in dentistry.

FIG. 6 shows brush 10 connected to regular plumbing features of a bathroom by installation of a water powered saliva ejector kit. Brush 10 is connected to pickup tube 60 which is attached to connector 61. Connector 61 connects to water line 64 and to disposal tube 62. Connected to disposal tube 62 is fitting 63 which is placed in a drain. Water flowing from water line 64, though connector 61, and out disposal tube 62 creates a vacuum in pickup line 60.

Figure 7:
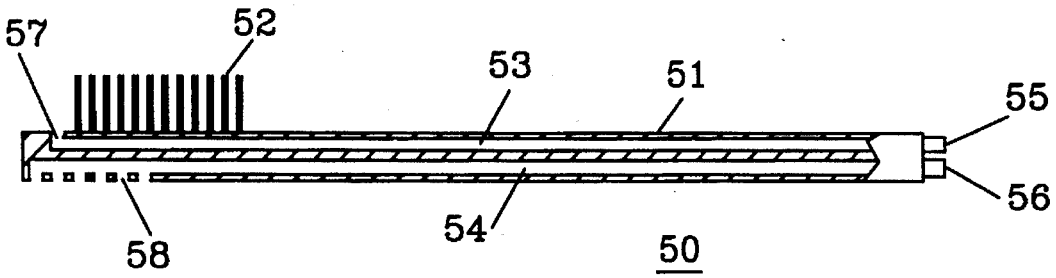
FIG. 7 shows another embodiment of the invention.

FIG. 7 illustrates an embodiment of the invention having two internal channels. Tooth brush 50 has a handle 51 with brush bristles 52 near one end of handle 51. Handle 51 has two internal channels 53 and 54. Channel 53 has an inlet 55, extends the length of handle 52 and ends in an opening 57 adjacent bristles 52. The exact location of opening 57 is not critical as long it is adjacent to bristles 52 and is on the same side of handle 51 as is bristles 52.

The second channel 54 has an outlet 56 and extends to openings 58 on the bristle end of handle 51, but is on the opposite side of handle 51 from bristles 52. Channel 53 may be, for example, a channel for directing water into the mouth for brushing teeth. Channel 54 is for aspirating the water and other liquids and debris from the mouth. A vacuum is applied to inlet 56. Water is supplied to inlet 55.

Brush 50 may be connected to a source of water and vacuum similar to that illustrated in FIGS. 4. Water is first allowed to enter the mouth. The water supply is shut off while the teeth are being brushed. The water is then turned on to rinse the mouth while a vacuum is applied to removed the water and other unwanted material in the mouth.

What is claimed:

1. An aspirating tooth brush, comprising:

an elongated handle having first and second ends;

a plurality of bristles on one side of the first end of said handle;

at least one opening in said handle near said first end on a side of said handle opposite from said one side;

a first channel inside said handle extending from said at least one opening to an outlet in the second end of said handle; and a reduced portion on the second end for receiving a vacuum tube.

2. The tooth brush according to claim 1, including a plurality of openings in said handle adjacent said at least one opening.

3. The tooth brush according to claim 1, wherein a vacuum is drawn through said at least one opening.

4. The tooth brush according to claim 1, including a second channel in said handle, separate from and independent of said first channel.

5. The tooth brush according to claim 4, wherein said second channel is connected to at least one opening adjacent said bristles.

6. The tooth brush according to claim 5, wherein said second channel is connected to a water source.

7. The tooth brush according to claim 1, including at least one opening in said handle adjacent said bristles.

8. An aspirating tooth brush, comprising:

an elongated handle having first and second ends;

a plurality of bristles on one side of the first end of said handle;

at plurality of openings in said handle near said first end on a side of said handle opposite from said one side;

at least one channel inside said handle extending from said plurality of openings to an opening in the second end of said handle; and a reduced diameter outlet connection on said second end for attaching a vacuum line.

9. The tooth brush according to claim 8, including a second separate and independent channel in said handle.

10. The tooth brush according to claim 9, wherein said second channel is connected to at least one opening adjacent said bristles.

11. The tooth brush according to claim 9, wherein said second channel is connected to a water source.

12. The tooth brush according to claim 8, including at least one opening in said handle adjacent said bristles.

13. An aspirating tooth brush, comprising:

an elongated handle having first and second ends;

a plurality of bristles on one side of the first end of said handle;

a least one first opening in said handle near said first end on a side of said handle opposite from said one side;

a first channel inside said handle extending from said at least one opening to an outlet in the Second end of said handle;

a reduced portion on the second end for receiving a vacuum tube;

at least one second opening adjacent said bristles; and a second channel separate and independent from said first channel extending from said at least second opening, to an inlet in said second end having a reduced diameter.

* * * * *